United States Patent [19]

Cook

[11] Patent Number: 4,846,862

[45] Date of Patent: Jul. 11, 1989

[54] RELIQUEFACTION OF BOIL-OFF FROM LIQUEFIED NATURAL GAS

[75] Inventor: Philip J. Cook, Schnecksville, Pa.

[73] Assignee: Air Products and Chemicals, Inc., Allentown, Pa.

[21] Appl. No.: 241,158

[22] Filed: Sep. 6, 1988

[51] Int. Cl.[4] ..... F25J 1/00

[52] U.S. Cl. ..... 62/9; 62/51.1; 62/54.1

[58] Field of Search ..... 62/54, 514 R, 9

[56] References Cited

U.S. PATENT DOCUMENTS

| | | | |
|---|---|---|---|
| 3,347,055 | 10/1967 | Blanchard et al. | 62/54 |
| 3,780,534 | 12/1973 | Lofredo et al. | 62/54 |
| 3,857,245 | 12/1974 | Jones | 62/54 |
| 3,857,251 | 12/1974 | Alleaume | 62/54 |
| 3,874,185 | 4/1975 | Etzbach | 62/54 |
| 3,889,485 | 6/1975 | Swearingen | 62/54 |
| 3,919,852 | 11/1975 | Jones | 62/54 |
| 4,188,793 | 2/1980 | Watson et al. | 62/54 |
| 4,543,794 | 10/1985 | Matsutani et al. | 62/54 |
| 4,766,741 | 8/1988 | Bartlett et al. | 62/54 |

*Primary Examiner*—Ronald C. Capossela

*Attorney, Agent, or Firm*—Russell L. Brewer; James C. Simmons; William F. Marsh

[57] ABSTRACT

The present invention relates to an improved process for the reliquefaction of boil-off gas containing up to 10% nitrogen resulting from the evaporation of liquefied natural gas (LNG) contained in a storage vessel. In the process, a closed-loop refrigeration cycle is utilized wherein an isenthalpically expanded stream is warmed against an initially cooled boil-off stream. The boil-off LNG stream is initially cooled by indirect heat exchange with an isentropically expanded refrigerant stream.

13 Claims, 3 Drawing Sheets

RELIQUEFACTION OF BOIL-OFF FROM LIQUEFIED NATURAL GAS

TECHNICAL FIELD

The present invention relates to a process for recovering liquefied natural gas (LNG) boil-off from a storage vessel.

BACKGROUND OF THE INVENTION

In ocean tankers carrying cargoes of liquid natural gas (LNG), as well as land based storage tanks, a portion of the liquid, normally amounting to approximately 0.1 to 0.25% per day in the case of LNG, is lost through evaporation as a result of heat leak through the insulation surrounding the LNG storage receptacle. Moreover, heat leakage into LNG storage containers on both land and sea causes some of the liquid phase to vaporize thereby increasing the container pressure.

Shipboard LNG storage tank boil-off has typically been used as an auxiliary fuel source to power the ship's boilers and generators. However, recent LNG tanker designs have incorporated the use of diesel engines rather than steam driven engines thereby eliminating the need for supplemental energy supplied by LNG boil-off.

Recently enacted legislation prohibiting tanker disposal of hydrocarbon-containing streams by venting or flaring within the vicinity of metropolitan areas coupled with an increased desire to conserve energy costs have led to incorporation of reliquefiers into the design of new tankers for recovering LNG boil-off.

Attempts have been made to recover nitrogen-containing natural gas boil-off vaporized from a storage tank. Typically, these systems employ a closed-loop refrigeration system wherein cycle gas is compressed, cooled and expanded to produce refrigeration prior to return to the compressor. The following patent is representative:

U.S. Pat. No. 3,874,185 discloses a reliquefaction process utilizing a closed-loop nitrogen refrigeration cycle wherein the lowest level or coldest level of refrigeration for condensation of LNG is provided by an isentropically expanded stream while the remaining refrigeration is provided by isenthalpic expansion of the residual second fraction of refrigerant. In one embodiment, the residual fraction of the isenthalpically expanded stream is subjected to a phase separation wherein liquid and vapor fractions are separated. During periods of low refrigeration requirements a portion of the liquid fraction is stored, and, during periods of higher refrigeration requirements, a portion of the stored liquid fraction is recycled into the refrigeration system.

SUMMARY OF THE INVENTION

The present invention provides a flexible and highly efficient process for reliquefaction of boil-off gas containing from 0 to about 10% nitrogen. Prior art processes are typically unable to efficiently reliquefy boil-off where the nitrogen content varies over such a wide range. They are designed to operate optimally within a narrow concentration range. As the concentration of contaminants moves away from design criteria, the reliquefiers become less efficient. Embodiments of the present invention eliminate this deficiency.

The present invention is an improvement in a process for reliquefying LNG boil-off resulting from the evaporation of liquefied natural gas within a storage receptacle utilizing a closed-loop nitrogen refrigeration cycle. In the process for reliquefying boil-off gas, the closed-loop refrigeration system comprises the steps:

compressing nitrogen as a working fluid in a compressor system to form a compressed working fluid;

splitting the compressed working fluid into a first and second stream;

isenthalpically expanding the first stream to produce a cooled first stream and then warming against boil-off gas and warming against recycle compressed working fluid;

isentropically expanding the second stream to form a cooled expanded stream and then warming against boil-off gas to form at least a partially condensed boil-off gas and warming against the working fluid; and finally returning the resulting warmed isenthalpically expanded and isentropically expanded streams to the compressor system.

The improvement for reliquefying LNG boil-off gas containing from about 0 to 10% nitrogen by volume in a closed loop refrigeration process comprises:

(a) effecting isenthalpic expansion of said first stream when the nitrogen content is from about 0–5%, under conditions such that at least a liquid fraction is generated at a pressure higher than the isentropically expanded stream;

(b) warming the liquid fraction against the partially condensed boil-off gas and against the compressed working fluid prior to returning said fraction to the compressor system.

When the nitrogen content is from about 5–10%, the process comprises the steps (a) effecting isenthalpic expansion of said first stream under conditions such that at least a liquid fraction is generated at a pressure higher than the isentropically expanded stream;

(b) warming the liquid fraction against the partially condensed boil-off gas and against the compressed working fluid prior to returning said fractions to the compressor system.

(c) separating any vapor fraction, if generated, from the liquid fraction;

(d) warming the vapor fraction, if generated, against boil-off gas and recycle compressed working fluid;

(e) splitting the liquid fraction formed in step (a) into a first major portion and a second minor portion;

(f) warming the first major portion of the liquid fraction against boil-off gas in parallel with the warming of said isentropically expanded second stream; and (g) isenthalpically expanding the second minor portion to produce a second cooled liquid fraction and a second vapor fraction and then warming the second cooled liquid fraction and said second vapor fraction against the partially condensed boil-off gas for effecting final condensation;

Several advantages are achieved by the present invention. They are:

(a) an ability to obtain a closer match between the warming curve of the refrigerant cycle gases and the cooling curve of the LNG boil-off stream thereby reducing energy requirements to achieve liquefaction; and (b) an ability to obtain greater efficiency permitting reduction of the heat exchanger surface area required to achieve liquefaction.

DETAILED DESCRIPTION OF THE INVENTION

The improvement in this process for reliquefying boil-off gases resulting from the evaporization of liquefied natural gas contained in a storage vessel is achieved through the modification of a closed-loop refrigeration system. Conventionally, the closed loop refrigeration systems use nitrogen as a refrigerant or working fluid, and in the conventional process, the nitrogen is compressed through a series of multi-stage compressors, usually in combination with aftercoolers, to a preselected pressure. This compressed nitrogen stream is split with one fraction being isenthalpically expanded and the other being isentropically expanded. Typically, the work from the isentropic expansion is used to drive the final stage of compression. Refrigeration is achieved through such isenthalpic and isentropic expansion and that refrigeration is used to reliquefy the boil-off gas. The objective is to match the cooling curves with the warming curves and avoid significant separations between such curves. Separations are evidence of lost refrigeration value.

Figure 1:
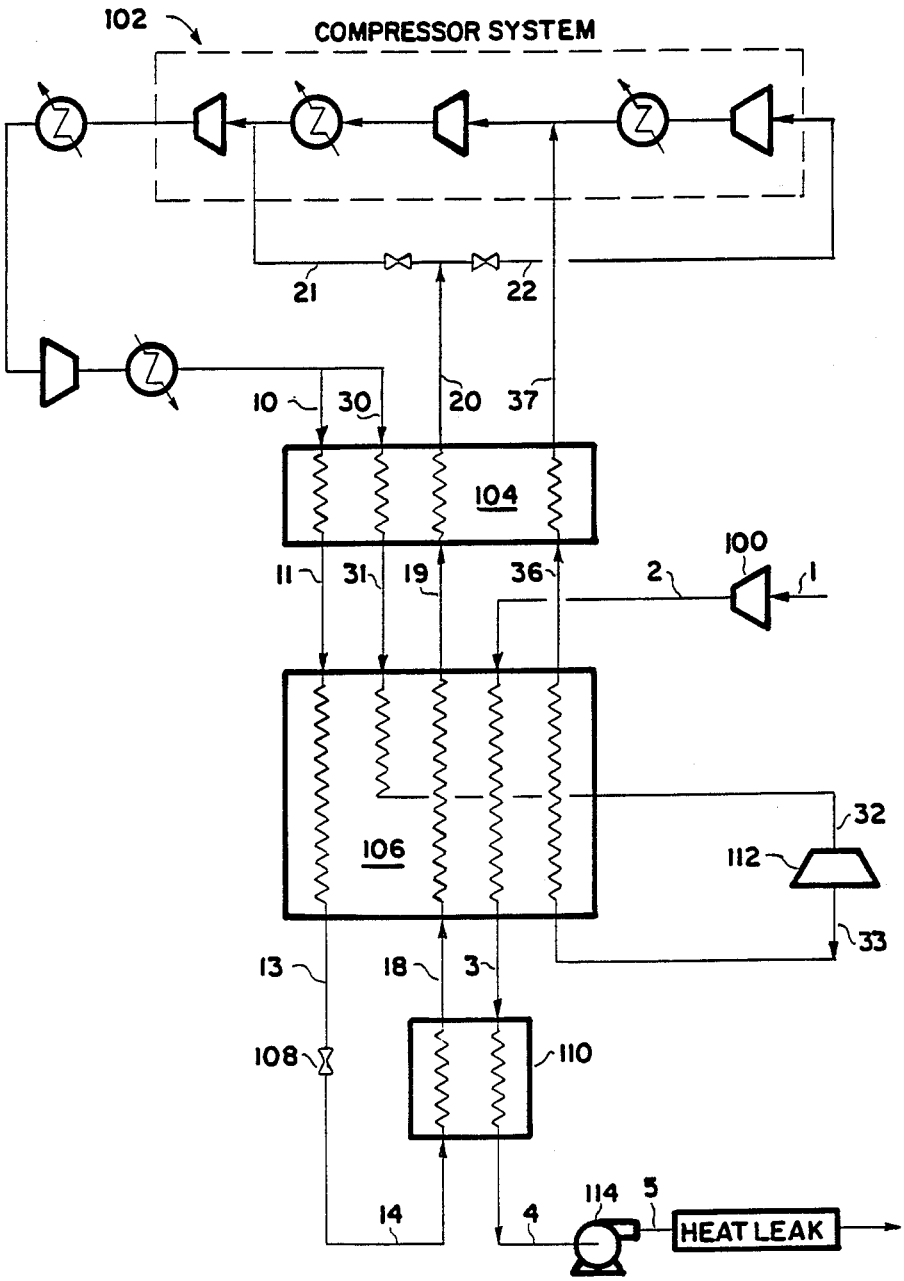
FIG. 1 is a process flow diagram illustrating the closed loop process referred to as an Expander J-T process.

To facilitate an understanding of one embodiment of the invention, reference is made to FIG. 1. In accordance with the embodiment referred to as the Expander-JT process as shown in FIG. 1, natural gas (methane) to be reliquefied is withdrawn from a storage tank (not shown) via conduit 1 and compressed in a boil-off compressor 100 to a pressure sufficient for processing during reliquefaction.

Refrigeration requirements for reliquefying the LNG boil-off are provided through a closed-loop refrigeration system using nitrogen as the working fluid or cycle gas. In this refrigeration system, nitrogen is compressed from ambient pressure through a series of multi-stage compressors having aftercoolers 102 to a sufficient pressure, e.g., 600–900 psia. Thermodynamic efficiency is enhanced by using large pressure differences in the nitrogen cycle.

The exhaust from the final compressor is split into a first stream 10 and a second stream 30. These streams are cooled in heat exchangers 104 and 106. The first stream 10 is passed through heat exchanger 104, line 11 through exchanger 106 reduced in temperature and then via line 13 isenthalpically expanded through Joule-Thompson (JT) Valve 108 to a pressure from about 200–320 psia and a temperature from about −240° F. to −265° F. Both liquid and gas fractions are formed. The effluent from Joule-Thompson Valve 108 then is warmed in indirect heat exchange in heat exchangers 110, 106, and 104 via lines 14, 18, and 19 prior to return to an intermediate section of the multi-stage compressor system 102 via lines 20 and 21 or 20 and 22. The remaining refrigeration is obtained wherein second stream 30 is also cooled in heat exchanger 104 then line 31 in heat exchanger 106 to a temperature of −80 to −120° F. and then via line 32 isentropically expanded in expander 112. The pressure after expansion is from about 70–120 psia and the temperature is from about −250° F to −280° F.

In contrast to prior art processes, the isentropically expanded fluid is withdrawn from expander 112 through line 33 and passed through exchangers 106 and 104 which are operated at temperatures higher than the final temperature of the condensed boil-off gas. The warmed working fluid is then returned or recycled via lines 36 and 37 to compressor system 102. In prior art processes, isentropically expanded fluid withdrawn via line 33 was used to provide the "coldest" level of refrigeration for the LNG, whereas in the Expander JT process, the isenthalpically expanded stream via line 14 is used to provide its coldest level of refrigeration and thus, refrigerate the boil-off to its coldest level.

Reliquefaction of the boil-off gas is achieved by cooling against the isenthalpically expanded stream and the isentropically expanded stream in heat exchanger 106 and 110. As a first step, the boil-off gas is initially compressed from ambient to about 30 psia in compressor 100. Then it is cooled in heat exchanger 106 against both the isentropically expanded and isenthalpically expanded working fluid to form a partially condensed boil-off stream. It is then cooled to its ultimate liquefaction temperature e.g., −244° F. to −258° F. in heat exchanger 110. Refrigeration for heat exchanger 110, to provide final condensation of the partially condensed stream however, is supplied by the isenthalpically expanded first stream. The reliquefied boil-off gas from heat exchanger 110 is withdrawn through line 4 and then pressurized by pumping through pump 114 and returned to the storage vessel.

In another embodiment of the invention, referred to as the dual JT or Joule-Thompson process, more efficient refrigeration can be achieved than through the particular embodiment referred to as the Expander JT process just described particularly those LNG streams containing higher concentrations of nitrogen, e.g., from about 5–10% by volume. To facilitate an understanding of the Dual JT process, reference is made to FIG. 2. To some extent, the embodiment is essentially the same as that of the Expander JT system except that the first stream is cooled and isenthalpically expanded to an intermediate pressure to form a subcooled liquid. A minor portion of the resulting liquid undergoes a second isenthalpic expansion, and provides the lowest level of refrigeration. Thus, a major portion of the liquid produced in the first isenthalpic expansion provides the bulk of the refrigeration in parallel with the isentropically expanded stream. For expediency, the numbering system used in FIG. 1 has been used in FIG. 2 and the components function and operate in essentially the same manner as in the embodiment described in FIG. 1.

In the reliquefaction process, the first stream 10 via line 11 is cooled in heat exchangers 104 and 106 and further via line 12 cooled in heat exchanger 110. The cooled first stream at a temperature from about −270° F. to −282° F. is withdrawn through line 213 and expanded in JT valve 215 under conditions sufficient to generate a subcooled liquid e.g., to a pressure from about 130 to 260 psia. Separator 217 is provided after the first isenthalpic expansion to permit storage of liquid for subsequent use in the event of flowrate or composition change and to permit the separation of vapor, if generated by the expansion, from the liquid. The vapor space in separator 217 communicates through dashed line 219 with conduit line 18 exiting heat exchanger 110 for permitting vapor flow from conduit line 18 to separator 217 or vice versa. The liquid fraction is withdrawn from separator 217 and split into two portions. One portion i.e., the major portion is removed via line 14 and warmed against boil-off gas and against the first stream prior to its first isenthalpic expansion via lines 18, 19 and 20 prior to return to compressor system 102. The balance or minor portion of stream 221 is expanded through Joule-Thompson valve 223 to a pressure from about 35 to 50 psia and conducted via line 114 through heat exchanger 116. In heat exchanger 116, the boil-off gas is condensed and cooled to its lowest temperature level e.g., −290° F. to −300° F. against the expanded refrigerant. The isenthalpically expanded minor portion is then conveyed via lines 118, 119 and 120 through heat exchangers 106 and 104 to compressor system 102. The isentropic expansion of second stream 30 is conducted in essentially the same manner as was done in the Expander JT FIG. 1 process. However, some process modifications should be made because of the increased nitrogen content and greater refrigeration requirements. Second stream 30 is cooled to a temperature from about −80° to −120° F. and then conveyed via line 32 to expander 112. It is then expanded to a pressure of about 60 to 100 psia which is intermediate the pressure between the first and second isenthalpic expansion of the first stream. The isentropically expanded stream is conveyed via line 33 to heat exchanger 110 then via lines 34 and 36 through heat exchangers 106 and 104 and then via line 37 to compressor system 102. Again, the coldest level of refrigeration for the boil-off is supplied through the isenthalpic expansion of the working fluid in contrast to systems which have used isentropically expanded working fluids as the coldest level of refrigeration.

Liquefaction of boil-off is achieved in the following manner: The boil-off gas is removed from the storage vessel via line 1 and compressed in boil-off gas compressor 100 and then passed via lines 2, 3 and 4 through heat exchangers 106, 110, 116 for liquefaction. On exiting heat exchanger 116, the liquefied LNG is removed via line 5 and pressurized in pump 225 where it is transferred via line 6 to the storage vessel.

To summarize when the boil-off gas nitrogen content is from 5–10%, the pressure required for the isenthalpically expanded stream to totally liquefy the boil-off gas decreases. The Dual JT process to effect reliquefaction of the boil-off stream uses two levels of refrigeration. The bulk of the refrigeration is supplied by a higher pressure isenthalpically expanded stream in parallel with an isentropically expanded stream and the final cooling is provided by a minor stream which undergoes a second isenthalpic expansion to the required lower pressure. Through this two stage isenthalpic expansion enhanced process efficiency is achieved when higher nitrogen concentrations e.g., 5–10% by volume are present in the feed.

The following examples are provided to illustrate various embodiments of the invention and are not intended to restrict the scope thereof.

EXAMPLE 1

Expander JT Process

A recovery system for LNG boil-off was carried out in accordance with the process scheme as set forth in FIG. 1. Nitrogen concentrations varied from 0% to about 10% by volume of the boil-off gas. Table 1 provides stream properties and rates in 1b moles/hr corresponding to the numbers designated in FIG. 1 for a boil-off gas containing 0% LNG.

Table 2 provides field properties corresponding to numbers designated in FIG. 1 or for a boil-off gas containing approximately 10% nitrogen by volume.

Table 3 provides stream properties corresponding to a prior art process scheme described in U.S. Pat. No. 3,874,185 where the nitrogen concentration in the boil-off gas is 0%.

Table 4 provides stream properties for liquefaction of a boil-off gas containing 10% nitrogen.

TABLE 1

FIG. 1 - EXPANDER JT - 0% $N_2$

| Stream No. | $N_2$ lb Moles/hr | $CH_4$ Moles/hr | T °F. | Press. Psia | Phase |
|---|---|---|---|---|---|
| 1 | — | 327 | −151 | 14.9 | VAP |
| 2 | — | 327 | −54 | 30 | VAP |
| 3 | — | — | −243 | 28 | VAP |
| 4 | — | 327 | −244 | 27 | LIQ |
| 10 | 909 | — | 95 | 796 | VAP |
| 13 | 909 | — | −243 | 788 | VAP |
| 14 | 909 | — | −248 | 315 | LIQ |
| 18 | 909 | — | −249 | 313 | VAP |
| 20 | 909 | — | 87 | 307 | VAP |
| 21 | 909 | — | 87 | 307 | VAP |
| 30 | 1879 | — | 95 | 800 | VAP |
| 31 | 1879 | — | −54 | 796 | VAP |
| 32 | 1879 | — | −105 | 792 | VAP |
| 33 | 1879 | — | −256 | 96 | VAP |
| 36 | 1879 | — | −256 | 92 | VAP |
| 37 | 1879 | — | −77 | 90 | VAP |

TABLE 2

FIG. 1 - EXPANDER JT - 10% $N_2$

| Stream No. | $N_2$ lb Moles/hr | $CH_4$ Moles/hr | T °F. | Press. Psia | Phase |
|---|---|---|---|---|---|
| 1 | 32 | 289 | −202 | 15.5 | VAP |
| 2 | 32 | 289 | −125 | 30 | VAP |
| 3 | 32 | 289 | −246 | 28 | VAP |
| 4 | 32 | 289 | −296 | 27 | LIQ |
| 10 | 736 | — | 99 | 800 | VAP |
| 13 | 736 | — | −246 | 788 | LIQ |
| 14 | 736 | — | −300 | 45 | VAP |
| 18 | 736 | — | −250 | 43 | VAP |
| 20 | 736 | — | 95 | 37 | VAP |
| 22 | 736 | — | 95 | 37 | VAP |
| 30 | 1746 | — | 99 | 800 | VAP |
| 32 | 1746 | — | −112 | 792 | VAP |
| 33 | 1746 | — | −260 | 96 | VAP |
| 36 | 1746 | — | −147 | 92 | VAP |
| 37 | 1746 | — | 95 | 90 | VAP |

TABLE 3

Figure 3:
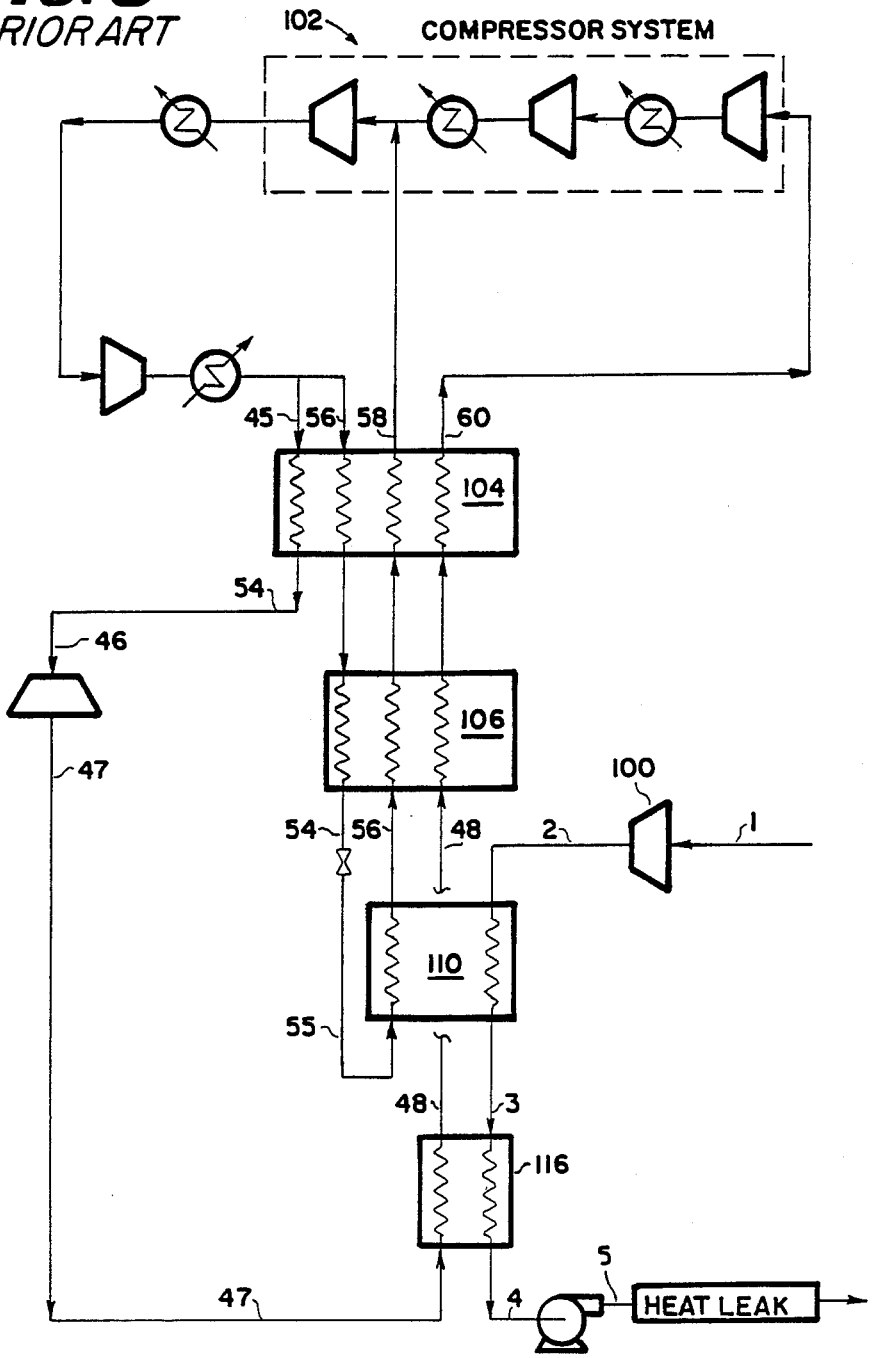
FIG. 3 PRIOR ART
FIG. 3 is a process flow diagram of a prior art closed loop process for recovering boil-off gas.

PRIOR ART - FIG. 3 - U.S. Pat. No. 3,874,185 - 0% $N_2$

| Stream No. | $N_2$ lb Moles/hr | $CH_4$ Moles/hr | T °F. | Press. Psia | Phase or Dew Point °C. |
|---|---|---|---|---|---|
| 1 | — | 292 | −138 | 14.9 | VAP |
| 2 | | 292 | −38 | 30 | VAP |
| 3 | | 292 | −243 | 28 | V + L |
| 4 | | 292 | −276 | 27 | LIQ |
| 45 | 2368 | — | 95 | 653 | VAP |
| 46 | 2368 | — | −150 | 647 | VAP |
| 47 | 2368 | — | −278 | 91.1 | VAP |
| 48 | 2368 | — | −245 | 88.1 | VAP |
| 60 | 2368 | — | 90 | 85 | VAP |
| 52 | 415 | — | 95 | 653 | VAP |
| 54 | 415 | — | −243 | 641 | LIQ |
| 55 | 415 | — | −247 | 348 | LIQ |
| 56 | 415 | — | −126 | 343 | VAP |
| 58 | 415 | — | 90 | 337 | VAP |

TABLE 4

| PRIOR ART - FIG. 3 - U.S. Pat. No. 3,874,185 - 10% $N_2$ | | | | | |
|---|---|---|---|---|---|
| Stream No. | $N_2$ lb Moles/hr | $CH_4$ Moles/hr | T °F. | Press. Psia | Phase |
| 1 | 32 | 289 | −202 | 15.5 | VAP |
| 2 | 32 | 289 | −125 | 30 | VAP |
| 3 | 32 | 289 | −260 | 28 | V + L |
| 4 | 32 | 289 | −296 | 27 | LIQ |
| 5 | 32 | 289 | −295 | 60 | LIQ |
| 45 | 2056 | — | 99 | 653 | VAP |
| 46 | 2056 | — | −164 | 480 | VAP |
| 47 | 2056 | — | 298 | 48 | VAP |
| 48 | 2056 | — | −263 | 45 | VAP |
| 60 | 2056 | — | 94 | 42 | VAP |
| 52 | 391 | — | 99 | 653 | VAP |
| 54 | 391 | — | −260 | 641 | VAP |
| 55 | 391 | — | −263 | 202 | V + L |
| 56 | 391 | — | −150 | 197 | VAP |
| 58 | 391 | — | 94 | 191 | VAP |

Calculations were made determining the heat exchanger requirements expressed as U times A where U is the heat transfer coefficient and A is the area of heat exchanger surface for the processes set forth in Tables 1–4. Compressor power requirements are also given. These values are set forth in Table 5.

TABLE 5

| Process | Boil-off $N_2$ % | Heat Exchanger (UA)(BTU/$H_F$ °F.) | Power HP |
|---|---|---|---|
| Table 1 | 0 | 779,715 | 2,713 |
| Table 2 | 10 | 708,380 | 3,490 |
| Table 3 | 0 | 797,115 | 2,802 |
| Table 4 | 10 | 702,100 | 3,550 |

From these results, it can be seen the Expander JT system (Table I) is superior to the Table 3 prior art system at a 0% $N_2$ level in the feed. At the 10% $N_2$ level, the process is comparable.

EXAMPLE 2

Figure 2:
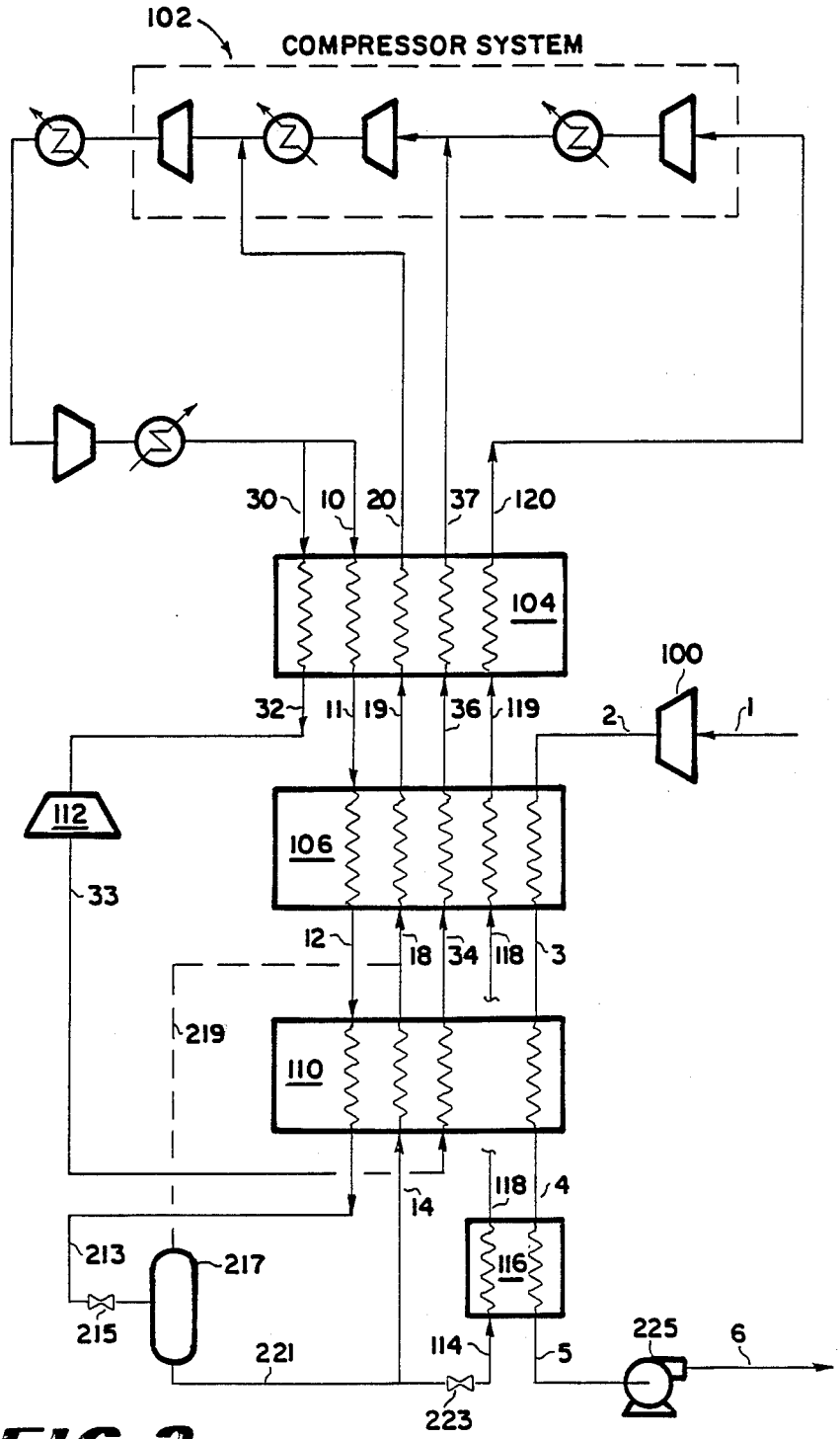
FIG. 2 is a process flow diagram of a closed loop process referred to as the Dual J-T process.

The procedure of Example 1 was repeated except that the process scheme of FIG. 2 was utilized for the 10% nitrogen case. As noted from FIG. 2, the Expander JT process of FIG. 1 is modified slightly to handle the additional load required by the higher nitrogen content in the feed. A minor fraction of the liquid from isenthalpic expansion undergoes a second isenthalpic expansion to supply the coldest level refrigeration for condensing the boil-off gas. Table 6 presents stream properties for a Dual-JT process scheme using boil-off gas containing 10% nitrogen.

TABLE 6

| FIG. 2 - DUAL JT - 10% $N_2$ | | | | | |
|---|---|---|---|---|---|
| Stream No. | $N_2$ lb Moles/hr | $CH_4$ Moles/hr | T °F. | Press. Psia | Phase |
| 1 | 32 | 289 | −202 | 15.5 | VAP |
| 2 | 32 | 289 | −125 | 30 | VAP |
| 3 | 32 | 289 | −246 | 28 | VAP |
| 4 | 32 | 289 | −278 | 27 | LIQ |
| 5 | 32 | 289 | −296 | 25 | LIQ |
| 6 | 32 | 289 | −295 | 60 | LIQ |
| 10 | 502 | — | 99 | 700 | VAP |
| 12 | 502 | — | −246 | 688 | LIQ |
| 213 | 502 | — | −278 | 685 | LIQ |
| 14 | 464 | — | −276 | 235 | LIQ |
| 114 | 38 | — | −300 | 44 | V + L |
| 118 | 38 | — | −282 | 42 | VAP |
| 120 | 38 | — | 94 | 36 | VAP |
| 18 | 464 | — | −250 | 232 | VAP |
| 20 | 464 | — | 94 | 226 | VAP |
| 30 | 2118 | — | 94 | 701 | VAP |

TABLE 6-continued

| FIG. 2 - DUAL JT - 10% $N_2$ | | | | | |
|---|---|---|---|---|---|
| Stream No. | $N_2$ lb Moles/hr | $CH_4$ Moles/hr | T °F. | Press. Psia | Phase |
| 32 | 2118 | — | −144 | 692 | VAP |
| 33 | 2118 | — | −282 | 84 | VAP |
| 34 | 2118 | — | −184 | 82 | VAP |
| 37 | 2118 | — | 94 | 78 | VAP |

The UA and horsepower requirements for this embodiment are shown in Table 7 along with values reproduced from Table 5.

TABLE 7

| Process | Boil-off $N_2$ % | Heat Exchanger (UA)(BTU/$H_F$ °F.) | Power HP |
|---|---|---|---|
| Table 1 | 0 | 779,715 | 2,710 |
| Table 2 | 10 | 708,380 | 3,490 |
| Table 3 | 0 | 797,115 | 2,800 |
| Table 4 | 10 | 702,100 | 3,550 |
| Table 6 | 10 | 709,680 | 2,940 |

From the above Table 7 and Table 5 in Example 1, the Expander-JT is the most efficient process when the nitrogen content in the boil-off gas is essentially in the 0–5% by volume range while the Dual JT process is the most efficient where the nitrogen content is approximately 5–10% by volume in the boil-off gas. The processes described in U.S. Pat. No. 3,874,185 are less efficient than the Expander-JT where the nitrogen content is from about 0–5% nitrogen and the Dual JT process is more effective when the nitrogen content is approximately 5–10%.

What is claimed:

1. In a process for liquifying boil-off gas resulting from the evaporation of liquified natural gas contained in a storage vessel, the boil-off gas being cooled and liquified in a closed-loop refrigeration system and then returned to said storage vessel wherein, said closed-loop refrigeration system comprises the steps:

compressing nitrogen as a working fluid in a compressor system to form a compressed working fluid;

splitting said compressed working fluid into a first and second stream;

isenthalpically expanding said first stream to produce a cooled first stream, then warming against boil-off gas and compressed working fluid; and isentropically expanding the second stream to form a cooled expanded stream which is then warmed against boil-off gas to form at least partially condensed boil-off prior to warming against the working fluid and prior to return to the compressor system;

the improvement for reliquifying a boil-off gas having from about 0 to 5% nitrogen by volume, which comprises:

(a) effecting isenthalpic expansion of said first stream when the nitrogen content is from about 0–5%, under conditions such that at least a liquid fraction is generated at a pressure higher than the isentropically expanded stream;

(b) warming the liquid fraction against the partially condensed boil-off gas and against the compressed working fluid prior to returning said fractions to the compressor system.

2. The process of claim 1 wherein the nitrogen working fluid is compressed to a pressure of from 600–900 psig.

3. The process of claim 2 wherein the first stream fluid is isenthalpically expanded to a pressure of from about 200–320 psia.

4. The process of claim 3 wherein the temperature of the first stream is cooled to about −240 to −265° F. prior to expansion.

5. The process of claim 4 wherein the second stream is cooled to a temperature of about −80 to about −120° F prior to expansion.

6. The process of claim 4 wherein the second stream is expanded to a pressure from about 70 to about 120 psia.

7. In a process for liquifying boil-off gas resulting from the evaporation of liquified natural gas contained in a storage vessel, the boil-off gas being cooled and liquified in a closed-loop refrigeration system and then returned to said storage vessel wherein said closed-loop refrigeration system comprises the steps:

compressing nitrogen as a working fluid in a compressor system to form a compressed working fluid;

splitting said compressed working fluid into a first and second stream;

isenthalpically expanding said first stream to produce a cooled first stream, then warming against recycle compressed working fluid and boil-off gas;

isentropically expanding the second stream to form a cooled expanded stream which is then warmed against boil-off gas and working fluid prior to return to the compressor system;

the improvement for reliquefying a boil-off gas containing from about 5 to 10% nitrogen by volume which comprises:

(a) effecting isenthalpic expansion of said first stream under conditions such that at least a liquid fraction is generated at a pressure higher than the isentropically expanded stream;

(b) separating any vapor fraction, if generated, from the liquid fraction;

(c) warming the vapor fraction, if generated, against boil-off gas and recycle compressed working fluid;

(d) splitting the liquid fraction formed in step (a) into a first major portion and a second minor portion;

(e) warming the first major portion of the liquid fraction against boil-off gas in parallel with the warming of said isentropically expanded second stream; and (f) isenthalpically expanding the second minor portion to produce a second cooled liquid fraction and a second vapor fraction and then warming the second cooled liquid fraction and said second vapor fraction against the partially condensed boil-off gas for effecting final condensation.

8. The process of claim 7 wherein the nitrogen working fluid is compressed to a pressure from about 600 to 900 psia.

9. The process of claim 8 wherein the first stream is cooled to a temperature from about −270 to −282° F. prior to the first isenthalpic expansion.

10. The process for claim 9 wherein the first stream is expanded to a pressure from 130 to 260 psia in the first isenthalpic expansion.

11. The process of claim 10 wherein the second stream is cooled to a temperature of from about −80° to −120° F. prior to isentropic expansion.

12. The process of claim 11 wherein the second stream is expanded to a pressure from about 60 to 100 psia.

13. The process of claim 12 wherein the pressure is reduced to about 35 to 50 psia by the second isenthalpic expansion of the first stream.

* * * * *